US010260337B2

(12) United States Patent
Van Dongen et al.

(10) Patent No.: US 10,260,337 B2
(45) Date of Patent: Apr. 16, 2019

(54) FRACTURE CHARACTERISATION

(71) Applicant: Maersk Olie og Gas A/S, Copenhagen (DK)

(72) Inventors: Hans Van Dongen, Copenhagen (DK); Joris De Iongh, Copenhagen (DK)

(73) Assignee: MAERSK OLIE GAS A/S, Copenhagen K (DK)

( * ) Notice: Subject to any disclaimer, the term of this patent is extended or adjusted under 35 U.S.C. 154(b) by 109 days.

(21) Appl. No.: 15/028,533

(22) PCT Filed: Oct. 30, 2014

(86) PCT No.: PCT/EP2014/073319
§ 371 (c)(1),
(2) Date: Apr. 11, 2016

(87) PCT Pub. No.: WO2015/063205
PCT Pub. Date: May 7, 2015

(65) Prior Publication Data

US 2016/0251958 A1 Sep. 1, 2016

(30) Foreign Application Priority Data

Oct. 30, 2014 (GB) ..... 1319184.6

(51) Int. Cl.
*E21B 49/00* (2006.01)
*E21B 47/06* (2012.01)
*E21B 33/14* (2006.01)

(52) U.S. Cl.
CPC ..... *E21B 49/008* (2013.01); *E21B 47/06* (2013.01); *E21B 47/065* (2013.01); *E21B 33/14* (2013.01)

(58) Field of Classification Search
CPC ..... E21B 49/008; E21B 47/06; E21B 47/065; E21B 33/13; E21B 33/14
See application file for complete search history.

(56) References Cited

U.S. PATENT DOCUMENTS 3,948,325 A * 4/1976 Winston ..... C09K 8/685 166/307
4,369,844 A * 1/1983 Clear ..... C09K 8/04 166/294
5,070,457 A 12/1991 Poulsen
(Continued)

FOREIGN PATENT DOCUMENTS

WO WO-03067025 A2 8/2003

OTHER PUBLICATIONS

Khalfan Shuaili et al., Fracture Growth Monitoring in Polymer Injectors-Field Examples, SPE International, SPE 160967., 2012, pp. 2-11.

(Continued)

*Primary Examiner* — Michael R Wills, III
(74) *Attorney, Agent, or Firm* — Harness, Dickey & Pierce, P.L.C.

(57) ABSTRACT

A method for determining one or more parameters of a formation fracture comprises injecting a viscous fluid in the formation via a flow path; measuring pressure at a location along the flow path; and calculating one or more parameters of a formation fracture based on the measured pressure. The method may permit improved and/or more efficient planning, design and/or performance of, e.g. conformance treatment of the formation fracture.

18 Claims, 6 Drawing Sheets

(56) References Cited

U.S. PATENT DOCUMENTS

| | | | | |
|---|---|---|---|---|
| 5,477,922 | A | 12/1995 | Rochon | |
| 7,314,082 | B2 | 1/2008 | Sweatman et al. | |
| 7,377,318 | B2 * | 5/2008 | Detournay | E21B 43/26 166/250.1 |
| 8,401,795 | B2 | 3/2013 | Kaageson-Loe et al. | |
| 2004/0016541 | A1 | 1/2004 | Detournay et al. | |
| 2004/0231849 | A1 | 11/2004 | Cooke | |
| 2006/0144587 | A1 | 7/2006 | Detournay et al. | |
| 2011/0198082 | A1 * | 8/2011 | Stromquist | E21B 43/114 166/298 |
| 2012/0181019 | A1 * | 7/2012 | Saini | B82Y 30/00 166/250.01 |

OTHER PUBLICATIONS

International Search Report PCT/ISA/210 for International Application No. PCT/EP2014/073319 dated Apr. 28, 2015.

Written Opinion of the International Searching Authority PCT/ISA/237 for International Application No. PCT/EP2014/073319 dated Apr. 28, 2015.

Search Report for corresponding Great Britain Application No. GB1319184.6 dated Apr. 17, 2014.

Ying Wang and R.S. Seright, "Correlating Gel Rheology With Behaviour During Extrusion Through Fractures", SPE, New Mexico Petroleum Recovery Research Center, Apr. 22-26, 2006, pp. 12.

Office Action for corresponding European Application No. 14 790 631.7 dated Mar. 16, 2017.

* cited by examiner

| V($m^3$) | △ P (Pa) |
|---|---|
| 0 | 0 |
| 0.141 | 37345 |
| 0.393 | 58318 |
| 1.004 | 88493 |
| 2.260 | 126640 |
| 4.020 | 163471 |
| 6.360 | 200495 |

(Table 1)

| | extreme swarm (10%) | fracture swarm (33%) | base case (100%) | reservior channel (300%) | extreme channel (1000%) |
|---|---|---|---|---|---|
| △ P (Pa) | 200495 | 200495 | 200495 | 200495 | 200495 |
| V($m^3$) | 0.64 | 2.12 | 6.36 | 19.08 | 63.60 |
| Rt (m) | 8.5 | 13.4 | 20.1 | 30.0 | 46.1 |
| W (m) | 0.0028 | 0.0038 | 0.0050 | 0.0068 | 0.0095 |

Figure 6
(Table 2)

FRACTURE CHARACTERISATION

CROSS-REFERENCE TO RELATED APPLICATIONS

This application is a national phase under 35 U.S.C. § 371 of PCT International Application No. PCT/EP2014/0733319 which has an International filing date of Oct. 30, 2014, which claims priority to United Kingdom Patent Application No. 1319184.6, filed Oct. 30, 2013, the entire contents of each of which are hereby incorporated by reference.

FIELD OF THE INVENTION

The present invention relates to a method for characterising a fracture in a formation, and in particular, though not exclusively, to a method for determining one or more parameters of a fracture by injecting a viscous fluid in a formation.

BACKGROUND TO THE INVENTION

A known problem in the oil and gas industry is the existence and/or development of fractures in a subterranean formation. Fractures in a formation may cause a number of problems at various stages of the exploitation of a formation, e.g. loss of drilling fluid during drilling, loss of injection fluid during Water Flooding or Enhanced Oil Recovery, or the like.

In order to optimise exploitation of the reservoir, it may be desirable or necessary to treat the fractured formation or "thief zone", e.g. by completely or at least partially plugging such fractures. Complete or at least partial plugging of the fractures is typically carried out by injecting a cement composition into the fractured formation. This process is commonly known as conformance control.

Conventional conformance treatment of a fractured formation typically follows a trial and error approach, involving pumping multiple batches of cement until the fracture is plugged. However, such an approach is highly inefficient.

U.S. Pat. No. 7,314,082 (Sweatman et al.) discloses a method of improving the pressure containment integrity of a wellbore, the method including pumping a fracture sealing composition into the wellbore. In order to estimate the pressure containment integrity improvement, equations based on an assumed fracture geometry describing the width profile of a fracture are used.

U.S. Pat. No. 8,401,795 (Kaageson-Loe et al.) discloses a method for identifying a risk zone in a segment of a planned wellbore, and selecting a solution to reduce fluid loss in the risk zone.

Published paper SPE 160967, 2012, "Fracture Growth Monitoring in Polymer Injectors-Field Examples" (Khalfan Shuaili et al.) discloses surveillance methods which are used to identify the existence and properties of fractures in polymer injectors. Pressure fall off tests used to determine fracture dimensions in polymer injectors have particular characteristics since they are influenced by shear-dependent viscosity seen in non-Newtonian fluids.

Published paper SPE 99462, 2006, "correlating Gel Rheology With Behaviour During Extrusion Through Fractures" (Wang and Seright) discloses methods using rheology measurements for assessing gel properties in fractures.

SUMMARY OF THE INVENTION

According to a first aspect of the present invention there is provided a method for determining one or more parameters of a formation fracture, comprising:

injecting a viscous fluid in the formation via a flow path;

measuring pressure at a location along the flow path; and calculating one or more parameters of a formation fracture based on the measured pressure.

The formation may typically comprise a subterranean formation.

The flow path may be defined by a wellbore. The wellbore may comprise the flow path.

The flow path and/or the wellbore may be in fluid communication with the formation and/or formation fracture. The method may comprise injecting a viscous fluid in a region of the formation at, near, and/or in fluid communication with the fracture. The method may comprise injecting a viscous fluid in the fracture. The method may comprise injecting a viscous fluid in or via the wellbore.

The method may comprise isolating a region of the flow path in fluid communication with the formation and/or formation fracture. In one embodiment, the method may comprise straddling a region of the flow path in fluid communication with the formation and/or formation fracture. The method may comprise straddling an injection point. The method may comprise straddling an injection point provided in an injection apparatus such as a tubular, liner, casing, tubing, or the like. The injection point may be defined by openings, e.g. perforations, holes, valves, or the like, in the injection apparatus. In the case of an open wellbore, the injection point may be defined by a region of the wellbore itself. The injection point may provide fluid communication between the flow path and the formation and/or formation fracture.

The wellbore may comprise an open hole wellbore section.

The wellbore may comprise a perforated cased and/or cemented wellbore.

One or more portions, e.g. an upper portion, of the wellbore may be cased and/or cemented, and one or ore portions, e.g. a lower portion, of the wellbore may be open.

The viscous fluid may comprise a polymer composition, e.g. a viscous non-Newtonian polymer composition. The viscous fluid may comprise and/or may be provided as a so-called "viscous polymer pill".

The method may comprise preparing a viscous polymer pill.

The method may comprise injecting the viscous polymer pill.

The viscous fluid may comprise a Bingham fluid.

The viscosity fluid may comprise a Herschel-Bulkley shear-thinning fluid. Use of a Herschel-Bulkley shear-thinning fluid may limit viscous pressure drop in conduits, e.g. tubulars, used to pump fluid(s) to/from the wellbore and/or formation, for example to avoid exceeding pressure ratings of injection pumps and/or tubulars. Without wishing to be bound by theory, it is believed that, when the viscous fluid enters the fracture, fluid velocities and shear-rates may drop substantially, which may result in increased fluid viscosities and downhole injection pressures.

In one embodiment, the viscous fluid may comprise a natural polymer, e.g. a xanthan polymer. In other embodiments, the viscous fluid may comprise any suitable viscous fluid, such as viscosifying additives for mud, brines, and other well treatment fluids. Selection of one or more viscous fluids may depend on temperature, pressure, availability, costs, stability, environmental acceptability, and the like.

The method may comprise injecting a predetermined and/or known amount, e.g. volume, of viscous fluid. One or more properties of the viscous fluid may be known, such as yield stress, consistency index, and/or power law index. One or more parameters of the viscous fluid injection process and/or system may be known, such as volume of viscous fluid, volumetric flow rate, and/or borehole radius.

The predetermined amount, e.g. volume, of viscous fluid injected may be selected and/or determined based on a desired treatment radius and/or an estimated fracture width. For example, the predetermined amount, e.g. volume, of viscous fluid may be determined based on a so-called "parallel plates fracture model", which assumes a substantially cylindrical fracture volume between two substantially parallel plates extending substantially perpendicular to an axis of the flow path and/or wellbore. The treatment radius may be defined as the radius of the "parallel plates fracture model" cylindrical volume substantially perpendicular to an axis of the flow path and/or wellbore. The fracture width may be defined as the width of the "parallel plates fracture model" cylindrical volume substantially parallel to an axis of the flow path and/or wellbore.

The method may comprise injecting, e.g. continuously injecting, the viscous fluid, at a predetermined, e.g. substantially constant, injection rate.

The method may comprise measuring and/or monitoring pressure and/or temperature, e.g. in a region of the flow path and/or wellbore in and/or near the formation.

The method may comprise measuring and/or monitoring pressure and/or temperature in a region of the flow path and/or wellbore at or near the formation fracture. The term "at or near the formation fracture" will be understood to refer to a region of the flow path and/or wellbore relatively close to the formation fracture in the context of a downhole assembly. The term "at or near the formation fracture" may encompass locations within several meters or within several tens of meters from the formation fracture. By such provision, the pressure and/or temperature measurement made may represent accurate measurements of pressure and/or temperature in respect of the formation fracture. This may avoid the need for correction of the measured values of pressure and/or temperature, which may help improve accuracy and/or reliability.

The method may comprise measuring and/or monitoring pressure and/or temperature in a region of the flow path and/or wellbore remote from the formation fracture, e.g. at or near surface and/or injection point. This may avoid the need for providing measurement apparatus downhole and/or in the wellbore. In such instance, if necessary, a correction factor may be applied. For example, the method may comprise correcting measured values of pressure and/or temperature between the location of measurement and the formation fracture, e.g. based on hydrostatic head and/or viscous pressure drop.

The method may comprise providing a pressure measuring apparatus and/or a temperature measuring apparatus temperature in a desired region of measurement, e.g. in a region of the flow path and/or wellbore at or near the formation fracture. The method may comprise providing the pressure measuring apparatus and/or the temperature measuring apparatus on or connected to a downhole and/or wellbore apparatus, e.g. straddle, plug, packer, tubular, coiled tubing, liner, or the like.

The method may comprise measuring pressure, e.g. back pressure, in the flow path and/or wellbore, e.g. during injection of the viscous fluid.

The method may comprise measuring pressure, e.g. back pressure, in the flow path and/or wellbore, e.g. on initial injection of the viscous fluid, and/or on termination of viscous fluid injection.

The pressure measuring apparatus and/or the temperature measuring apparatus may comprise a memory unit configured to store pressure and/or temperature measurement data. This may allow analysis of measurements to be performed, e.g. upon retrieval of the pressure measuring apparatus and/or the temperature measuring apparatus from the wellbore.

The pressure measuring apparatus and/or the temperature measuring apparatus may comprise remote communication capability. This may allow analysis, e.g. real-time or near real-time analysis of measurements by a user.

The method may comprise injecting in the formation a first fluid, e.g. a different fluid from the viscous fluid, before the viscous fluid. The method may comprise injecting in the formation a second fluid, e.g. a different fluid from the viscous fluid, after the viscous fluid.

The first fluid and the second fluid may be the same or different. In one embodiment, the first and/or second fluid, e.g. the first and the second fluid, may comprise an aqueous composition, e.g. sea water.

The method may comprise injecting, e.g. continuously injecting, the first fluid, viscous fluid, and second fluid, at a predetermined, e.g. substantially constant, injection rate.

The method may comprise measuring, e.g. continuously measuring, pressure, e.g. back pressure, in the flow path and/or wellbore during injection of the first fluid, viscous fluid, and second fluid. By such provision, the difference in pressure, e.g. back pressure, associated with the amount, e.g. volume, of viscous fluid injected in the formation, e.g. fracture, can be determined.

Due to the different rheological properties and/or behaviour of the first and/or second fluid, and of the viscous fluid, a change in back pressure and/or profile of the pressure measured during injection, may allow a user to identify the location of the viscous fluid or viscous polymer pill. For example, a change in back pressure and/or the profile of the pressure measured during injection, may allow a user to identify a point where the viscous fluid or viscous polymer pill comes into contact with the fracture, e.g. enters the fracture. A change in back pressure and/or the profile of the pressure measured during injection, may allow a user to identify a point where the viscous fluid or viscous polymer pill no longer enters the fracture, e.g. a point where the second fluid displaces the viscous fluid or viscous polymer pill from the fracture.

The method may comprise measuring a pressure difference, e.g. a difference in back pressure, associated with the viscous fluid, e.g. associated with the predetermined and/or known amount, e.g. volume, of viscous fluid.

The method may comprise using one or more equations, e.g. one or more equations describing pressure change associated with non-Newtonian fluids, to determine one or more parameters of the formation fracture.

The equation may comprise one or more variables such as fracture width and/or treatment radius. In one embodiment, the equation may be expressed in terms of variables comprising fracture width and treatment radius. The equation may comprise a combination of two or more known equations, such as an equation for change in pressure with change in radius (e.g. equation (1)), an equation for shear stress (e.g. equation (2)), an equation for shear rate (e.g. equation (3)), an equation for flow rate (e.g. equation (4)), and/or an equation for fracture volume (e.g. equation (8)).

The method may comprise using the measured pressure difference associated with the injected amount, e.g. volume, of viscous fluid, in the equation, to determine and/or calculate the fracture width and/or treatment radius.

In one embodiment, the method may comprise using one or more of equations (1) to (9):

$$\frac{dP}{dR} = \frac{2 \times SS}{W} \tag{1}$$

wherein

P is the back pressure associated with the viscous fluid.

SS is the shear stress associated with the viscous fluid,

R is the fracture radius,

W is the fracture width.

$$SS = Ty + k \times SR^{n} \text{ (known as Herschel-Bulkley)} \tag{2}$$

wherein

Ty is the yield stress associated with the viscous fluid, k is the consistency index associated with the viscous fluid, SR is the shear rate associated with the viscous fluid, n is the power law index associated with the viscous fluid.

$$SR = \frac{2 \times v}{0.5 \times W} \tag{3}$$

wherein v is the average velocity of the viscous fluid (velocity is zero at the wall).

$$Q = 2\pi R \times v \tag{4}$$

wherein Q is the volumetric flow rate of the injected viscous fluid.

Using (4) in (3), equation (5) is obtained:

$$SR = \frac{2 \times Q}{\pi R \times W^2} \tag{5}$$

Using (5) in (2), equation (6) is obtained $$SS = Ty + k \times \left(\frac{2 \times Q}{\pi R \times W^2}\right)^n \tag{6}$$

Using (6) in (1), equation (7) is obtained $$\frac{dP}{dR} = \frac{2 \times Ty}{W} + \frac{2 \times k}{W} \times \left(\frac{2 \times Q}{\pi R \times W^2}\right)^n \tag{7}$$

Thus:

$$\int_{Rw}^{Rt} dP = \int_{Rw}^{Rt} \left[\frac{2 \times Ty}{W} + \frac{2 \times k}{W} \times \left(\frac{2 \times Q}{\pi R \times W^2}\right)^n\right] dR \tag{7'}$$

wherein

Rw is the borehole radius,

Rt is the treatment radius.

And $$\Delta P = \frac{Rt \times 2Ty}{W} + \frac{2k}{W} \times \left(\frac{2 \times Q}{\pi \times W^2}\right)^n \times \frac{1}{1-n}\left[Rt^{(1-n)} - Rw^{(1-n)}\right] \tag{7''}$$

It is known that $$V = \pi \times W \times Rt^2 \tag{8}$$

and hence $$W = \frac{V}{\pi \times Rt^2} \tag{8'}$$

wherein V is the volume of the injected viscous fluid or viscous polymer pill.

Using (8') in (7"), equation (9) is obtained $$\Delta P = \frac{Ty \times 2\pi \times Rt^3}{V} + \frac{k \times 2\pi \times Rt^2}{V} \times \left(\frac{2\pi \times Q \times Rt^4}{V^2}\right)^n \times \frac{1}{1-n}\left[Rt^{(1-n)} - Rw^{(1-n)}\right] \tag{9}$$

Thus, from measurement of the pressure difference associated with a known volume of viscous fluid having known rheological parameters, the treatment radius Rt may be calculated, and hence the fracture width W.

The predetermined and/or known volume of viscous fluid, e.g. viscous polymer pill, may be designed and/or selected based on a desired or expected treatment radius (Rt) and expected fracture width (W).

The method may comprise determining an expected fracture width W and or treatment radius, e.g. based on seismic and/or geological data of region comprising, at or near the formation, on operators information, etc.

The method may comprise a preliminary step of determining a suitable volume of viscous fluid based on a desired treatment radius (Rt) and expected fracture width (W). The method may comprise designing a so-called "viscous pill" having an associated volume V and/or Back pressure ΔP. Based on a desired treatment radius (Rt) and expected fracture width (W), the method may comprise calculating an appropriate volume of fluid V, e.g. using equation (8), and/or calculating an associated expected ΔP, e.g. using equation (7").

The model selected for the above calculations may be based on a "parallel plates fracture model", which may assume a substantially cylindrical fracture volume between two substantially parallel plates.

The method may comprise performing a so-called sensitivity analysis. A sensitivity analysis may permit to fine-tune the model to take account of possible departure of the fracture geometry from the fracture model.

The method may comprise repeating the method, e.g. injecting viscous fluid in the formation, measuring change in pressure, and calculating one or more parameters of the formation fracture, for two or more amounts or volumes, e.g. different amounts or volumes, of viscous fluid. This may be described as a sensitivity analysis, which may provide a volume correction factor. By such provision, the influence of so-called fracture swarms and/or channels may be determined and/or analysed.

The terms "fracture swarms" and "fracture channels" are known to a person of ordinary skill in the art, and will be understood as examples of typical types of fractures geometries departing from the "parallel plates fracture model". A fracture swarm may be typically described as a fracture extending into the formation in the form of a plurality of adjacent troughs. A fracture channel may be typically described as a fracture extending into the formation in a non-circular or part-circular pattern. For example, rather than extending into the formation over 360°, the fracture may extend into the formation over a limited angle such as less than 360".

In one embodiment, the method may comprise analysing the curve of a graph showing measured ΔP as a function of V, e.g. to assess the likely type of fracture geometry.

Without wishing to be bound by theory, it is believed that a "fracture swarms" geometry may result in an increased curve and/or less linear shape in the "ΔP=f(V)" graph as compared to a corresponding graph following the "parallel plates fracture model". It is believed that a "fracture channel" geometry may result in a decreased curve and/or more linear shape in the "ΔP=f(V)" graph as compared to a corresponding graph following the "parallel plates fracture model".

The method may comprise designing and/or preparing a suitable conformance treatment. Advantageously, the determination of one or more parameters, e.g. fracture width and/or treatment radius, of the fracture, may permit improved and/or more efficient planning, design and/or performance of the conformance treatment.

The method may allow injecting a conformance composition in the formation. The method may comprise injecting an amount, e.g. volume, of conformance composition into the formation, based on one or more parameters of a formation fracture determined by the present method, such as fracture width and/or treatment radius. The method may comprise injecting a conformance composition into the formation at a rate, e.g. flow rate, selected based on one or more parameters, e.g. fracture width and/or treatment radius, of a formation fracture determined by the present method. Other parameters of the conformance treatment may be selected based on one or more parameters, e.g. fracture width and/or treatment radius, of a formation fracture determined by the method.

In one embodiment, the conformance treatment may comprise injecting a cement composition, e.g. in a region of the wellbore in fluid communication with the formation and/or formation fracture.

The cement composition may be selected to avoid gravity slumping in the fracture, e.g. upon completion of the conformance treatment.

In one embodiment, the cement composition may comprise a finely grained cement, a cross-linking polymer solution, or any other suitable water soluble and/or finely grained conformance composition. Such a cement composition may be suitable in the treatment of a narrow fracture, e.g. less than 2 mm, typically less than 1 mm, in width.

In another embodiment, the cement composition may comprise a light-weight cement containing hollow glass spheres (e.g. approximately 50 μm in diameter), a viscous epoxy, and/or any other suitable water soluble and/or or finely grained conformance composition. Such a cement composition may be suitable in the treatment of a wide fracture, e.g. more than 1 mm, typically more than 2 mm, in width.

According to a second aspect of the present invention there is provided a method for conforming a formation fracture, comprising:

injecting a viscous fluid in the formation via a flow path;

measuring pressure at a location along the flow path;

calculating one or more parameters of a formation fracture based on the measured pressure; and injecting a conformance composition into the formation.

The determination of one or more parameters, e.g. fracture width and/or treatment radius, of the fracture, may permit improved and/or more efficient planning, design and/or performance of the conformance treatment.

The method may allow injecting a conformance composition in the formation. The method may comprise injecting an amount, e.g. volume, of conformance composition into the formation, based on one or more parameters of a formation fracture determined by the present method, such as fracture width and/or treatment radius. The method may comprise injecting a conformance composition into the formation at a rate, e.g. flow rate, selected based on one or more parameters, e.g. fracture width and/or treatment radius, of a formation fracture determined by the present method. Other parameters of the conformance treatment may be selected based on one or more parameters, e.g. fracture width and/or treatment radius, of a formation fracture determined by the method.

In one embodiment, the conformance treatment may comprise injecting a cement composition, e.g. in a region of the flow path and/or wellbore in fluid communication with the formation and/or formation fracture.

The cement composition may be selected to avoid gravity slumping in the fracture, e.g. upon completion of the conformance treatment.

In one embodiment, the cement composition may comprise a finely grained cement, a cross-linking polymer solution, or any other suitable water soluble and/or finely grained conformance composition. Such a cement composition may be suitable in the treatment of a narrow fracture, e.g. less than 2 mm, typically less than 1 mm, in width.

In another embodiment, the cement composition may comprise a light-weight and/or low-density cement containing hollow glass spheres (e.g. approximately 50 μm in diameter), a viscous epoxy, and/or any other suitable water soluble and/or or finely grained conformance composition. Such a cement composition may be suitable in the treatment of a wide fracture, e.g. more than 1 mm, typically more than 2 mm, in width.

The features described in relation to any other aspect or the invention, can apply in respect of the method according to a second aspect of the present invention, and are therefore not repeated here for brevity.

According to a third aspect of the present invention there is provided a method for processing data, comprising:

receiving data associated with a formation fracture;

processing the received data to determine and/or calculate one or more parameters of the formation fracture.

The received data may comprise pressure data associated with injection of a viscous fluid in the formation. The received data may comprise pressure measurements associated with injection of a/the viscous fluid in the formation, e.g. formation fracture.

The features described in relation to any other aspect or the invention, can apply in respect of the method according to a third aspect of the present invention, and are therefore not repeated here for brevity.

BRIEF DESCRIPTION OF THE DRAWINGS

These and other aspects of the present invention will now be described, by way of example only, with reference to the accompanying drawings, in which:

FIG. 6 (Table 2) illustrates a typical sensitivity analysis based on a given back pressure and different volumes of viscous fluid.

DETAILED DESCRIPTION OF THE DRAWINGS

Figure 1:
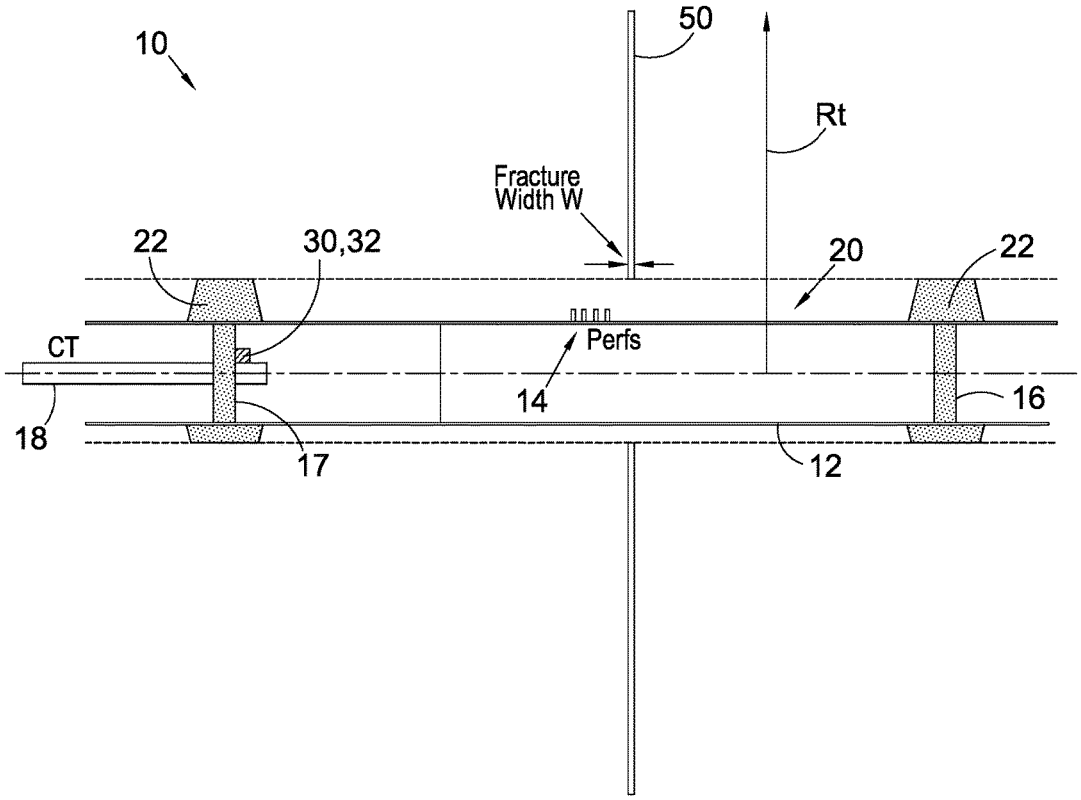
FIG. 1 is a schematic cross-sectional view of a downhole well completion and pumping assembly showing a formation fracture to be investigated and/or cemented according to an embodiment of the present invention.

FIG. 1 shows a schematic cross-sectional view of a downhole assembly, generally designated 10, showing a formation fracture 50 to be investigated and/or cemented according to an embodiment of the present invention.

The assembly comprises a liner 12 provided within a borehole 20. The liner has perforations 14 configured for injecting a composition into the borehole 20. The bore hole is sealed by plugs or packers 22, such as inflatable, swellable, and/or epoxy plugs or packers, to isolate a section of the borehole 20 one each side of the perforations 14 of the liner 12, in fluid communication with fracture 50.

A section of the liner 12 on each side of the perforations 14 is isolated using a plug 16 at a distal end thereof, and an inflatable plug 17 at a proximal end thereof. The inflatable plug 17 is configured to allow a coiled tubing 18 to be in fluid communication with the isolated section of the liner 12.

This assembly 10 allows a composition such as a viscous fluid to be injected into the fracture 50.

A pressure monitoring apparatus 30 is provided to measure the back pressure caused by injection of a fluid. In this embodiment, the pressure monitoring apparatus 30 is connected to the inflatable plug 17 and/or to the coiled tubing 18. In this embodiment, the pressure monitoring apparatus 30 comprises a memory unit 32 configured to store pressure measurement data.

Figure 2:
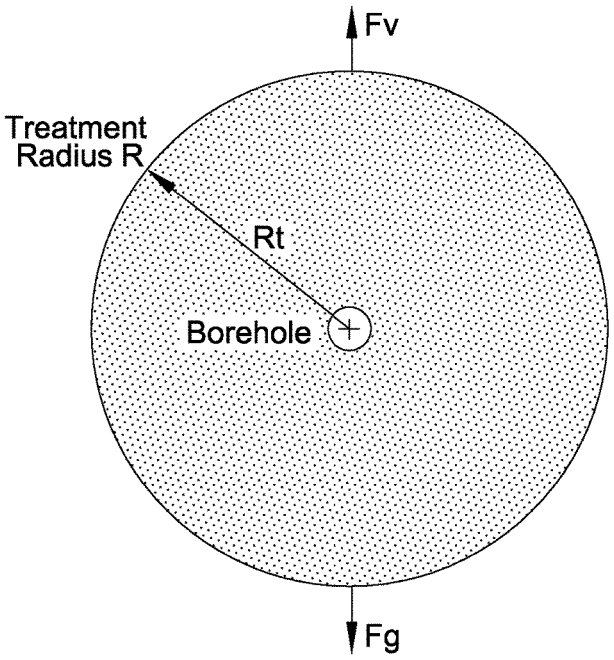
FIG. 2 is a schematic view of a parallel plates fracture model used in an embodiment of the present invention.

As illustrated in FIGS. 1 and 2, the fracture 50 is modelled using a parallel plates fracture model, having a width W, and a desired treatment radius Rt.

In this embodiment, the viscous fluid used to investigate the fracture 50 consisted of a xanthan polymer pill.

In this embodiment, the method was based on using the following equations:

$$\frac{dP}{dR} = \frac{2 \times SS}{W} \tag{1}$$

wherein

P is the back pressure associated with the viscous fluid,

SS is the shear stress associated with the viscous fluid,

R is the fracture radius,

W is the fracture width.

$$SS = Ty - k \times SR^n \text{ (known as Herschel-Bulkley)} \tag{2}$$

wherein

Ty is the yield stress associated with the viscous fluid, k is the consistency index associated with the viscous fluid, SR is the shear rate associated with the viscous fluid, n is the power law index associated with the viscous fluid.

$$SR = \frac{2 \times v}{0.5 \times W} \tag{3}$$

wherein v is the velocity of the viscous fluid (velocity is zero at the wall).

$$Q = 2\pi R \times W \times v \tag{4}$$

wherein Q is the volumetric flow rate of the injected viscous fluid

Using (4) in (3), equation 5 obtained:

$$SR = \frac{2 \times Q}{\pi R \times W^2} \tag{5}$$

Using (5) in (2), equation 6 obtained $$SS = Ty + k \times \left(\frac{2 \times Q}{\pi R \times W^2}\right)^n \tag{6}$$

Using (6) in (1), equation (7 obtained $$\frac{dP}{dR} = \frac{2 \times Ty}{W} + \frac{2 \times k}{W} \times \left(\frac{2 \times Q}{\pi R \times W^2}\right)^n \tag{7}$$

Thus:

$$\int_{Rw}^{Rt} dP = \int_{Rw}^{Rt} \left[\frac{2 \times Ty}{W} + \frac{2 \times k}{W} \times \left(\frac{2 \times Q}{\pi R \times W^2}\right)^n\right] dR \tag{7'}$$

wherein

Rw is the borehole radius,

Rt is the treatment radius.

And $$\Delta P = \frac{Rt \times 2Ty}{W} + \frac{2k}{W} \times \left(\frac{2 \times Q}{\pi \times W^2}\right)^n \times \frac{1}{1-n}[Rt^{(1-n)} - Rw^{(1-n)}] \tag{7''}$$

It is known that $$V = \pi \times W \times Rt^2 \tag{8}$$

and hence $$W = \frac{V}{\pi \times Rt^2} \tag{8'}$$

wherein V is the volume of the injected viscous fluid or viscous polymer pill.

Using (8') in (7"), equation (9) is obtained $$\Delta P = \frac{Ty \times 2\pi \times Rt^3}{V} + \frac{k \times 2\pi \times Rt^2}{V} \times \left(\frac{2\pi \times Q \times Rt^4}{V^2}\right)^n \times \frac{1}{1-n}[Rt^{(1-n)} - Rw^{(1-n)}] \tag{9}$$

Thus, from measurement of the pressure difference associated with a known volume of the xanthan pill having known rheological parameters, the treatment radius Rt may be calculated, and hence the fracture width W.

Viscous Pill Design

A viscous pill having suitable characteristics (V, ΔP), based on desired treatment radius (R) and expected fracture width (W), was designed.

To do this, the treatment radius (R) was chosen to be Rt=30 m, and the expected fracture width (W) was selected to be W=5 mm (0.005 m).

The xanthan polymer pill prepared for this experiment had the following rheological properties:

$k=3.24\ Pa\cdot s^{-n}$; n=0.3225; and Ty=16.34 Pa.

The known parameters in equation (9) for the xanthan pill used in this embodiment were as follows:

Q=2 bpm=0.0053 $m^3/s$

Rw=0.1 m

Thus, based on the desired treatment radius (Rt) and expected fracture width (W), the associated expected ΔP can be calculated using equation (7"):

$$\Delta P=(30\times2\times16.34/0.005)+(2\times3.24/0.005)\times(2\times0.0053/3.14\times(0.005)^2)^{0.3225}\times(1/(1-0.3225))\times[30^{(1-0.3225)}-(0.1)^{(1-0.3225)}]$$

$$\Delta P\approx200{,}000\ Pa$$

The associated volume of fluid V can be calculated using equation (8):

$$V=\pi W\times Rt^2$$

$$V=3.14\times0.005\times30^2$$

$$V\approx14\ m^3$$

Thus, ΔP≈2.0 bar for W=5 mm (V=14 $m^3$)

This method allows a user to select a viscous pill having suitable characteristics (V, ΔP) for carrying out investigation in a fracture having a desired treatment radius (R) and expected fracture width (W).

Model Investigation

The profile of the back pressure ΔP against injected volume V was investigated.

Using equation (9) above, the back pressure ΔP was calculated for increasing volumes of viscous fluid V.

Figures 3A, 3B:
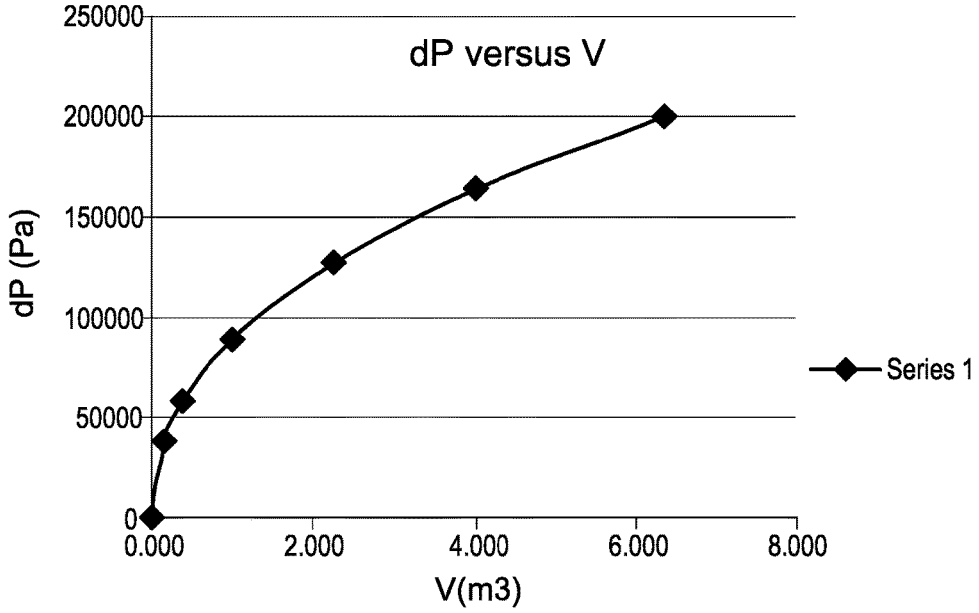
FIGS. 3A (Table 1) and 3*b* illustrate calculated pressure difference against different volumes of viscous fluid.

The results as shown in Table 1 and FIG. 3. The graph depicting ΔP as a function of V is a non-linear curve. This shows that, upon initial injection of a viscous fluid into the fracture, the resulting back pressure will sharply increase. However, at a latter stage of injection of the viscous pill, injection of viscous fluid results in a comparatively lesser increase in back pressure.

For the purpose of fracture characterisation, an investigator may choose to select a volume V of viscous pill which is less than the volume V calculated using the above viscous pill design model. This is because the cost saving associated with a reduction in the volume of the viscous pill may outweigh the experimental benefit of conducting fracture characterisation associated with the full volume of fluid calculated during viscous pill design. This is because the injection of the final volume of viscous pill may not generate a significant increase in the measured ΔP.

The profile of the calculated fracture width against the associated pressure difference was also investigated. For this experiment, the volume of viscous fluid selected was 40 bbls (barrels), i.e. 6.36 $m^3$. This amount was considered sufficient for the purpose of fracture characterisation, based on the total calculated volume of 14 $m^3$ calculated during the "viscous pill design" above, and the cost vs benefit consideration discussed above.

Figure 4:
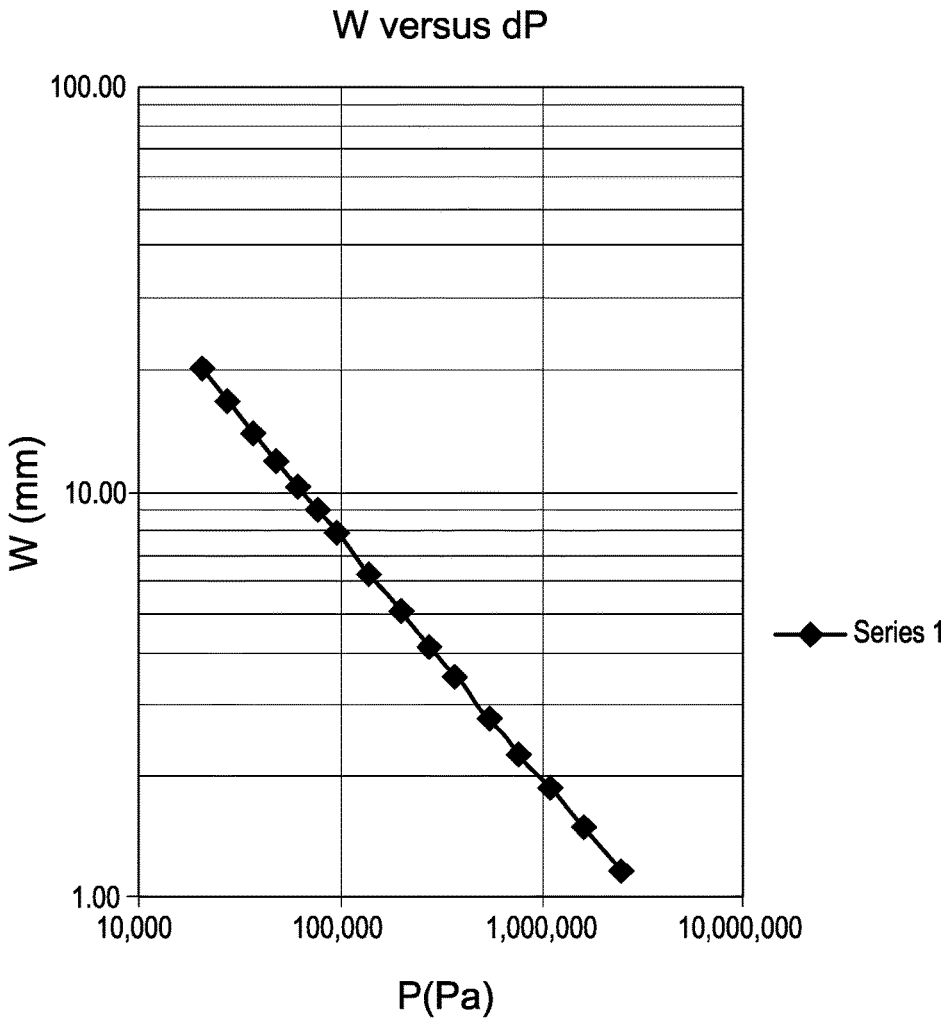
FIG. 4 is a graph illustrating calculated fractured width against the associated pressure difference for a given viscous pill different volume.

For different treatment radii, the associated ΔP and fracture width W were calculated using equations (9) and (8') above. Results are shown in FIG. 4. As can be seen in FIG. 4, the larger the fracture width, the lower the ΔP is required to inject a given volume of viscous fluid.

Fracture Characterisation

The method comprised continuously injecting sequentially sea water, the xanthan polymer pill, and sea water, at a substantially constant injection rate, in this example at 2 bbl/min (0.0053 $m^3/s$).

The method comprised continuously measuring back pressure in the formation during injection of the composition using pressure monitoring apparatus 30.

Figure 5:
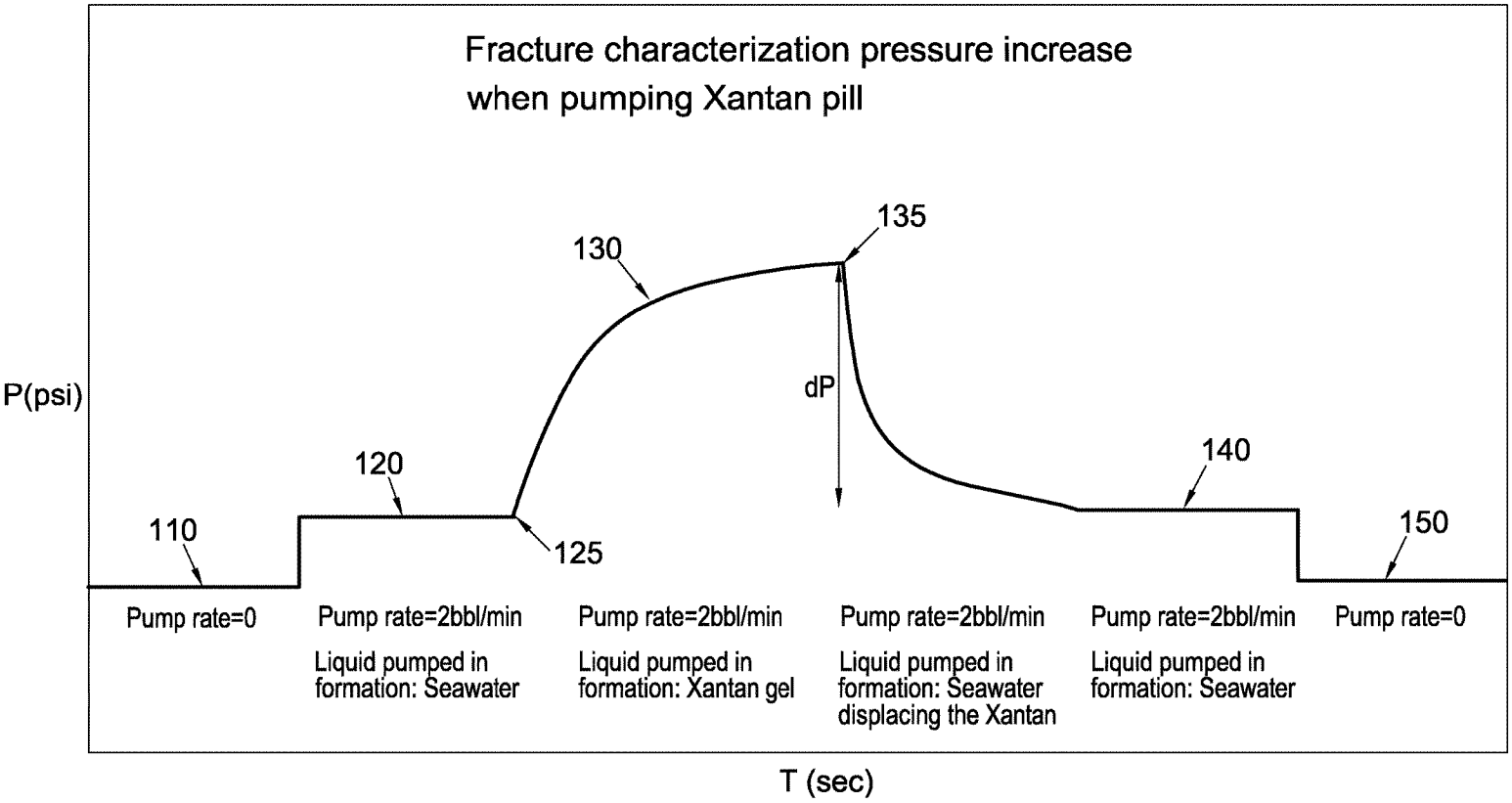
FIG. 5 is a graph showing back pressure measured against time during injection of a sea water/viscous polymer pill/sea water sequence.

FIG. 5 is a graph showing back pressure measured against time during injection of a sea water/viscous xanthan pill/sea water sequence.

The graph of FIG. 5 shows a first portion 110 during which the pump rate was nil, a second portion 120 exhibiting constant back pressure during which sea water was pumped, a third portion 130 exhibiting variable back pressure during which the xanthan pill was injected, a fourth portion 140 exhibiting constant back pressure during which sea water was pumped, and a fifth portion 150 during which the pump rate was nil.

As can be seen from FIG. 5, due to the different rheological behaviour of sea water and viscous xanthan pill, the point where the xanthan pill enters the fracture can be identified as 125, and the point where the xanthan pill is displaced by sea water from the fracture can be identified as 135.

The pressure difference caused by the viscous xanthan pill can be directly measured as ΔP. Therefore, using equation (9), the actual treatment radius Rt may be calculated, and hence, using equation (8'), the fracture width W.

Sensitivity Analysis

As will be appreciated, any model selected for fracture characterisation may not always accurately reflect the actual fracture geometry. By way of example, the model used herein based on a "parallel plates fracture model" assumes a substantially cylindrical fracture volume between two substantially parallel plates. In order to fine-tune the model to take account of possible departure of the fracture geometry from the fracture model, a so-called sensitivity analysis was carried out. This may permit detection of so-called fracture swarms and/or channels in the formation.

In a typical experiment, sequential injecting of sea water/xanthan pill/sea water, and measurement of associated back pressure, would be repeated for a number of different amounts or volumes of the xanthan pill.

In the present experiment, for simplicity, the "measured" back pressure ΔP was assumed to be constant, as per the back pressure ΔP associated with the base volume of viscous fluid. The base volume of viscous fluid selected was 40 bbls (barrels), i.e. 6.36 $m^3$ for the reasons explained above in relation to the "model investigation".

Using equation (9), the associated ΔP was calculated to be ΔP=200495 Pa.

The experiment consisted of calculating the treatment radius Rt and fracture width W, for different volumes of the xanthan pill, and the "measured" (herein assumed constant) ΔP.

The volumes selected were 10%, 33%, 100%, 300% and 1000% of the nominal (base) 100% treatment volume associated with the parallel plates model.

The results are shown in Table 2.

This experiment demonstrates the influence of the type of fracture geometry on the calculated treatment radius (Rt) and fracture width (W).

In a typical experiment, the measured changes in ΔP may be indicative of the type of fracture geometry. For example, a large increase in ΔP for a comparatively low increase in total treatment volume V may be indicative of a fracture channel geometry. Conversely, a low increase in ΔP for a comparatively large increase in total treatment volume V may be indicative of a fracture swarm geometry.

Various modifications may be made to the embodiment described without departing from the scope of the invention.

The invention claimed is:

1. A method for determining one or more parameters of a formation fracture in a formation, comprising:

injecting a viscous fluid in the formation via a flow path, the viscous fluid including a viscous non-Newtonian polymer composition;

injecting a first fluid before the viscous fluid;

injecting a second fluid after the viscous fluid, the first fluid and the second fluid being different from the viscous fluid;

measuring back pressure in the flow path during the injecting of the first fluid, viscous fluid, and second fluid; and calculating one or more parameters of the formation fracture based on the measured back pressure.

2. The method according to claim 1, wherein the flow path is defined by a wellbore.

3. The method according to claim 1, wherein the flow path is in fluid communication with the formation and/or formation fracture.

4. The method according to claim 1, comprising straddling an injection point of the flow path in fluid communication with the formation and/or formation fracture.

5. The method according to claim 1, comprising injecting a predetermined amount of the viscous fluid.

6. The method according to claim 5, wherein the predetermined amount of the viscous fluid is selected based on at least one of a desired treatment radius and an estimated fracture width.

7. The method according to claim 1, comprising injecting the viscous fluid at a predetermined injection rate.

8. The method according to claim 1, comprising measuring the back pressure in a region of the flow path in and/or near the formation and/or formation fracture.

9. The method according to claim 1, wherein measuring the back pressure includes measuring a pressure difference associated with the viscous fluid.

10. The method according to claim 9, comprising using the measured pressure difference associated with the injected viscous fluid, in one or more equations, to determine at least one of a fracture width and/or treatment radius.

11. The method according to claim 1, wherein measuring the back pressure includes using one or more equations describing pressure change associated with non-Newtonian fluids, to determine one or more parameters of the formation fracture.

12. The method according to claim 1, comprising a preliminary step of determining a suitable volume of viscous fluid based on at least one of a desired treatment radius and expected fracture width.

13. The method according to claim 1, comprising performing a sensitivity analysis.

14. The method according to claim 13, comprising repeating the injecting a viscous fluid in the formation via a flow path, the measuring back pressure in the flow path, and the calculating one or more parameters of a formation fracture based on the measured back pressure, for two or more different amounts or volumes of the viscous fluid.

15. The method according to claim 1, comprising designing and/or preparing a conformance treatment.

16. The method according to claim 15, comprising injecting an amount of conformance composition into the formation, based on one or more calculated parameters of the formation fracture.

17. The method according to claim 16, wherein the one or more parameters comprises at least one of fracture width and treatment radius.

18. The method according to claim 1, wherein the viscous fluid includes a Herschel-Bulkley shear-thinning fluid.

* * * * *